US005788245A

United States Patent [19]

Hada

[11] Patent Number: 5,788,245

[45] Date of Patent: Aug. 4, 1998

[54] GAME MACHINE FOR PLAYING BALL THROW AND METHOD OF ADJUSTING TARGET BEHAVIOR IN THE SAME

[75] Inventor: Naoyuki Hada, Tokyo, Japan

[73] Assignee: Sega Enterprises, Ltd., Tokyo, Japan

[21] Appl. No.: 351,080

[22] Filed: Nov. 30, 1994

[30] Foreign Application Priority Data

| | | | |
|---|---|---|---|
| Nov. 30, 1993 | [JP] | Japan | 5-326344 |
| Dec. 8, 1993 | [JP] | Japan | 5-340240 |
| Feb. 21, 1994 | [JP] | Japan | 6-046352 |

[51] Int. Cl.[6] ..... F41J 7/04

[52] U.S. Cl. ..... 273/392

[58] Field of Search ..... 273/369, 371, 273/334, 375, 376, 386, 390, 391, 392

[56] References Cited

U.S. PATENT DOCUMENTS

| | | | |
|---|---|---|---|
| 3,874,664 | 4/1975 | Faurot | 273/29 A |
| 4,426,085 | 1/1984 | Dixon | 273/392 |
| 4,534,557 | 8/1985 | Bigelow | 273/55 A |
| 4,979,752 | 12/1990 | Fosseen | 273/392 |
| 5,167,386 | 12/1992 | Simmons | 273/392 |
| 5,232,227 | 8/1993 | Bateman | 273/392 |
| 5,433,451 | 7/1995 | Vvles | 273/392 |

FOREIGN PATENT DOCUMENTS

| | | |
|---|---|---|
| 59-102088 | 7/1984 | Japan . |
| 4-5865 | 1/1992 | Japan . |
| 5-29573 | 4/1993 | Japan . |
| 5-29575 | 4/1993 | Japan . |
| 5-51395 | 7/1993 | Japan . |

*Primary Examiner*—Theatrice Brown

*Attorney, Agent, or Firm*—Finnegan, Henderson, Farabow, Garrett & Dunner, L.L.P.

[57] ABSTRACT

A game machine for playing a ball throw, in which a player throws a ball at a target arranged in a board. The game machine comprises an element for attaching the target to the board, the target swinging from a given vertical position to a given horizontal position, a unit for providing a holding force to the target positioned at the vertical position, and a control unit for decreasing stepwise or continuously the holding force in accordance with an elapsed time of a ball-throw game. The probability for knocking down the targets is properly adjusted.

13 Claims, 12 Drawing Sheets

GAME MACHINE FOR PLAYING BALL THROW AND METHOD OF ADJUSTING TARGET BEHAVIOR IN THE SAME

BACKGROUND OF THE INVENTION

1. Field of the Invention

The present invention relates to a game machine for playing ball throw and a method of adjusting the behavior of a target in the game machine.

2. Description of Related Art

There is a wide variety of game machines for playing ball throw (hereinafter referred to as a "ball-throw game machine"). Among them are ball-throw game machines in which players simply select desired targets and throw balls at the targets to make them fall down.

Players throw balls during a given time interval or throw a certain number of balls to compete with each other for the number of hit targets or scores. Players may also compete with each other for the number of times required to or hit or knock down all of the targets or a given number of targets. In any ball-throw game machine, targets are set to fall down under an unchanging condition during the period of playing the game. For example, targets may fall down only if hit by balls with the proper speed.

Hence, a player can finish the ball-game in a very short time if only balls thrown at the proper speed hit targets. In most such cases, this results in giving an unsatisfied feeling to the player. Furthermore, when a skilled player and a non-skilled player compete with each other, the fun of competition may diminish for them due to a large difference in the scores or in the game times.

SUMMARY OF THE INVENTION

Accordingly, it is an object of the present invention to provide a ball-throw game machine and a method of adjusting the behavior of targets arranged in the ball-throw game machine in which a player, even a skilled player, can play for a long time and in which skill in such a ball game does not produce a great difference in scores or the game playing time.

As one aspect of the invention, there is provided a game machine for playing ball throw, in which a player throws a ball at a target arranged in a board member, the game machine comprising: means for attaching the target to the board member, the target swinging from a given vertical position to a given horizontal position; a unit for providing a holding force to the target positioned in the vertical position; and a control unit for decreasing the holding force in accordance with the elapsed time of a ball-throw game.

It is preferred that the target structure consist of a plurality of targets arranged in a regular configuration in the board member, each of the plurality of targets being a plate member. Preferably, the plate member is provided in rectangle form.

Preferably, the control unit comprises an element for measuring the elapsed time of the ball-throw game, and an element for stepwise decreasing the holding force in accordance with the measured elapsed time. It is further preferred that the holding force decreasing element comprise a time judging element for judging whether the elapsed time has reached a single specified value; and an element for stepwise removing the holding force when the time judging element judges that the elapsed time has reached the single specified value.

Furthermore, it is preferred that the game machine additionally: a sensor for detecting a tilt angle of the target; a tilt judging element for judging whether the detected tilt angle reaches a specified angle; and an element for compulsorily removing the holding force independently of judgments of the time judging element when the tilt judging element judges that the detected tilt angle has reached the specified angle.

Preferably, the control unit comprises an element for measuring the elapsed time of the ball-throw game, and an element for continuously decreasing the holding force in accordance with the measured elapsed time. It is preferred that the holding force providing element comprise a pinching member for pinching the target; and an electric solenoid for applying the holding force against the pinching member, wherein the holding force decreasing element gradually decreases the energy of pulsed electric currents supplied to the electric solenoid.

As another aspect of the invention, a method is provided for adjusting the behavior of a target in a ball-throw game machine, in which a player throws a ball at the target held so as to swing from a vertical position to a horizontal position. The method comprises the steps of: applying a holding force to the target when it is positioned in a vertical position; and decreasing the holding force in accordance with the elapsed time of the ball-throw game.

DETAILED DESCRIPTION OF THE PREFERRED EMBODIMENTS

A first embodiment of the present invention will now be explained with reference to FIGS. 1 to 7.

Figure 1:
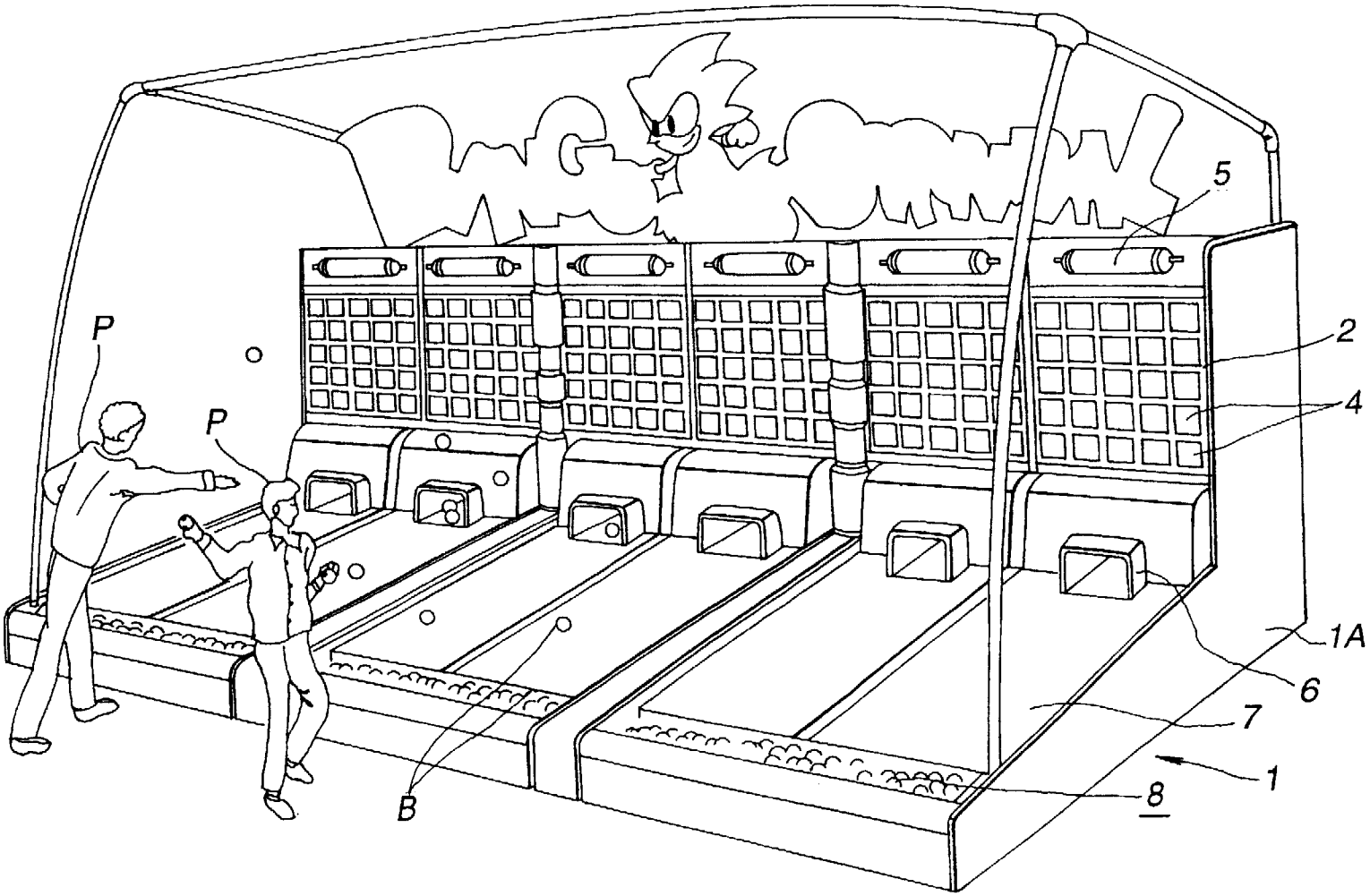
FIG. 1 shows a perspective view of a combined system of ball-throw game machines arranged in accordance with a first embodiment of the invention.

FIG. 1 shows a combined system of a plurality of ball-throw game machines. As shown therein, six ball-throw game machines 1 are in disposed parallel and arranged as a combination in a packaged system. Each ball-throw game machine 1 has a board 2 which stands perpendicularly on a base 1A. As illustrated, a player P participates in the game at a position some distance in front of the board 2. The board 2 has a square shape and contains a total of 25 rectangular holes 3 (FIG. 3) are regularly arranged in a lattice form of 5-rows and 5-columns. Each rectangular hole 3 is covered by a target 4 consisting of a square plate made of metal, plastic, wood material or the like, and the target 4 is arranged to open or close the hole 3.

The board 2 may employ a 16-target configuration of 4-rows and 4-columns or a 9 target configuration of 3-rows and 3-columns instead of the foregoing 5-row and 5-column configuration.

On the frontal upper part of the board 2, an LED display unit 5 is disposed to show game information including scores. At the frontal bottom of the board 2, a ball discharge port 6 is provided so as to open frontward. A ball-carrying plate 7 extends from the ball discharge port 6 to the front of the base 1A, the ball-carrying plate 7 being placed so as to be slightly, downwardly inclined toward the front. A concavity 8 is formed at the front of the ball-carrying plate 7 for storing returned balls.

A player P will select one ball-throw game machine 1 and stand closely to the ball-storing concavity 8. The player P then picks a ball B up from the ball-storing concavity 8 in order to throw it at targets 4 arranged in the board 2 of the selected machine and located some distance from the player P.

If the thrown ball B hits one of the targets 4, the hit target 4 will fall down backward to open its rectangular hole 3. The ball B which has hit the target 4 will then bounce in various ways. In some cases, the bouncing ball B will return to the ball-storing concavity 8 via the ball-carrying plate 7. In other cases, the bouncing ball B will go through the rectangular hole 3 to the backside of board 2 concurrently with the knocking down of the target 4. The ball B which enters the backside will then be discharged from the discharge port 6 to the ball-storing concavity 8 via the ball-carrying plate 7. The rectangular hole 3 remains open once its target 4 falls down. Another ball B also thrown by the player P may pass the opened rectangular hole 3 to the backside and will be discharged from the ball discharge port 6. On the other hand, the ball B which has not hit a target 4 or has not knocked down a target 4 will bounce frontward and return to the ball-storing concavity 8 via the ball-carrying plate 7.

A standing/falling mechanism which allows each of the targets 4 to enter into a vertical or horizontal position or state will be explained according to FIGS. 2 to 4.

Each of the rectangular holes 3 has a rectangular trimming edge 2*a* therearound, which is formed by extending the front surface of the board 2 inward slightly over the rectangular hole 3. Thus the rectangular trimming edge 2*a* forms a slight rectangular protrusion. The target 4 is formed into an appropriate rectangular shape fittable from the backside of the board 2 through the aperture of the rectangular hole 3 with an appropriate clearance left between the target 4 and the rectangular hole 3 and stopped by the rectangular trimming edge 2*a*.

The lower end of the target 4 is bent backward to form a bent portion 4*a* through which a lateral axis 10 passes horizontally. The lateral axis 10 is attached securely to the bent portion 4*a*. One end of the lateral axis 10 is rotatably held by a bearing 11 securely attached to the back of the board 2, while its other end is coupled with a drive shaft of an electric rotary solenoid 12 also attached to the back of the board 2. Each of the targets 4 is thus supported so as to swing around the lateral axis 10 by both the bearing 11 and the rotary solenoid 12. The rotary solenoid 12 is able to drive the lateral axis 10 to erect the target 4.

An electric motor can be used instead of the above rotary solenoid 12.

Figure 2:
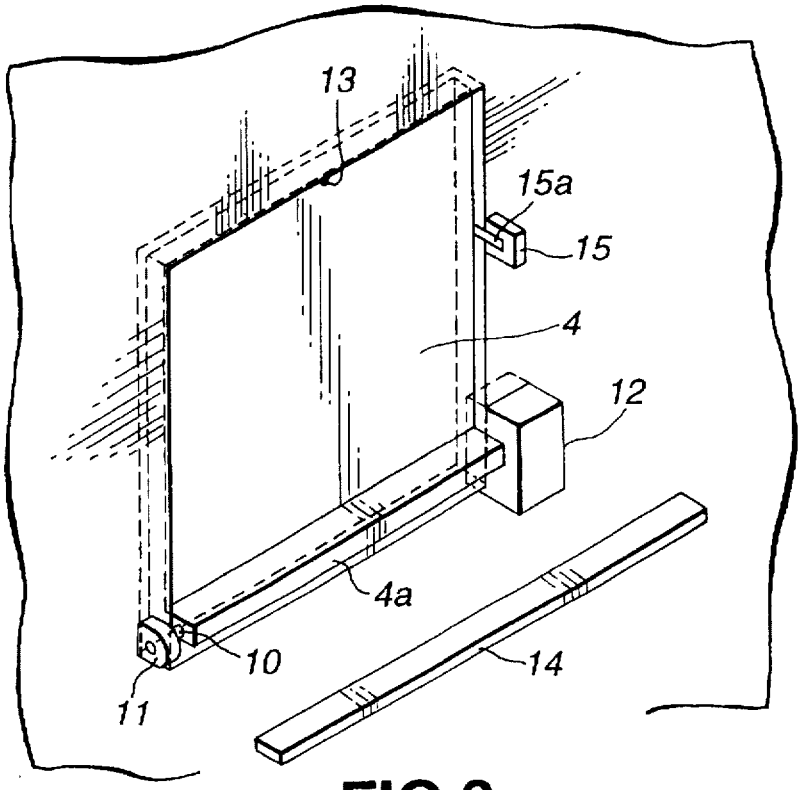
FIG. 2 shows a view illustration a vertical position of a target of one of the ball-throw game machines.
Figure 3:
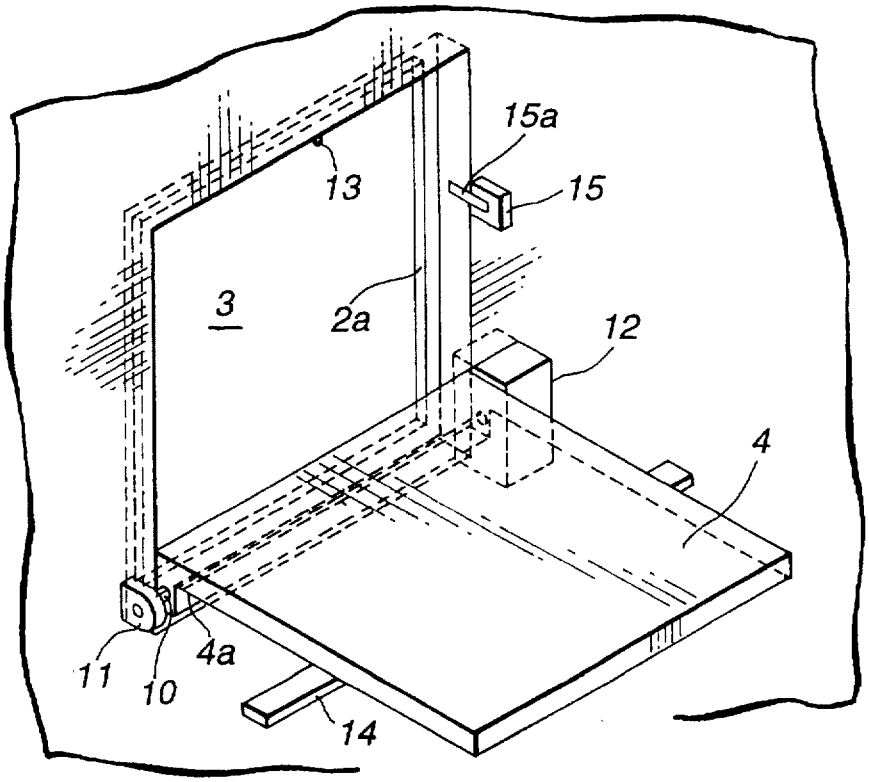
FIG. 3 is a view of a horizontal position of the target.
Figure 4:
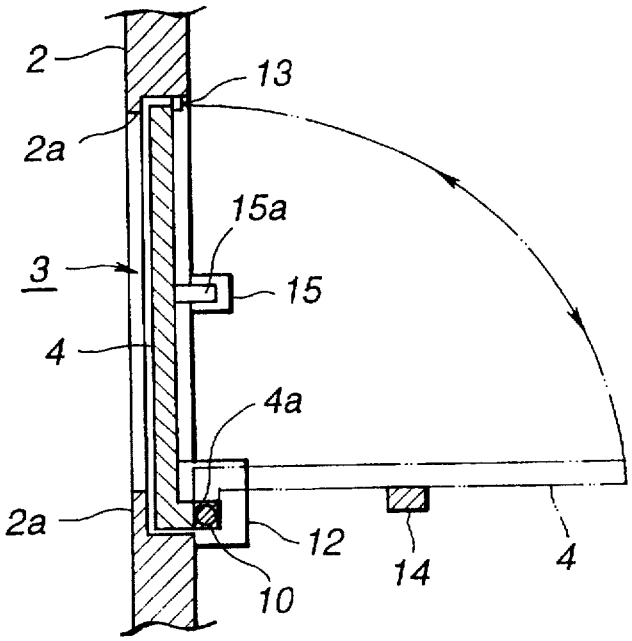
FIG. 4 is a side, cross sectional view of the target.

When the target 4 is erected, the rectangular trimming edge 2*a* protruding out over the rectangular hole 3 functions as a stopper for the target 4 and the target 4 closes the rectangular hole 3 (FIGS. 2 and 4).

As shown in FIG. 4, on the upper side of the rectangular hole 3, a protrusion 13 extends from the board 2 into the opening 3 to hold the standing target 4 in cooperation with the rectangular trimming edge 2*a*. The protrusion 13 is normally pushed downwardly by a spring (not shown) to protrude into the opening 3 as shown. When the target 4 is moved to its vertical position, the protrusion 13 touches the free end of the target 4, so that the protrusion 13 is pushed into the board 2. When the target 4 has passed over the protrusion 13 to the rectangular trimming edge 2*a*, the protrusion 13 springs downward again to hold the free end of the target 4, together with the rectangular trimming edge 2*a*. In this manner, the target 4 is kept in its vertical position.

The spring used for the protrusion 13 has a weak, but appropriate, spring constant, so that low-level vibration and the like do not allow the target 4 to fall down by itself, but the hit of a ball on the target 4 enables the protrusion 13 to be pushed up enabling the target 4 to fall down easily.

In addition, at a given position in the back space of the board 2, a cross bar 14 (FIG. 4) is bridged horizontally and laterally at almost the same level as the lateral axis 10. The cross bar 14 then functions as a stopper to hold the target 4 in an approximately horizontal position, when the target 4 has fallen to its horizontal position. Accordingly, the target 4 can swing around the lateral axis 10 between the standing-up position limited by the rectangular trimming edge 2*a* of the board 2 and the falling-down position limited by the cross bar 14.

Furthermore, on the back of the board 2, a limit switch 15 is arranged at a given position of one of the two vertical ends of each rectangular hole 3. The limit switch 15 includes an actuating piece 15*a* extending in front of the board 2 and bent to reach the inside of each hole 3.

The vertical position of the target 4 allows one vertical end of the target 4 to make contact with the actuating piece 15*a* and push the limit switch 15 to an "on" state. An angular range from the standing-up position to a backward-inclined position of a specified angle (for example, approximately 10 degree from the vertical axis) will maintain such contact to allow the "on" state of the limit switch 15. However, when the target 4 exceeds the specified angle, the contact between the actuating piece 15*a* and the target 4 will be lost, and the limit switch 15 goes off.

The above-explained standing/falling mechanism is arranged for each of the targets 4 and its motion is controlled by a control unit 19 incorporating a microcomputer therein.

Figure 5:
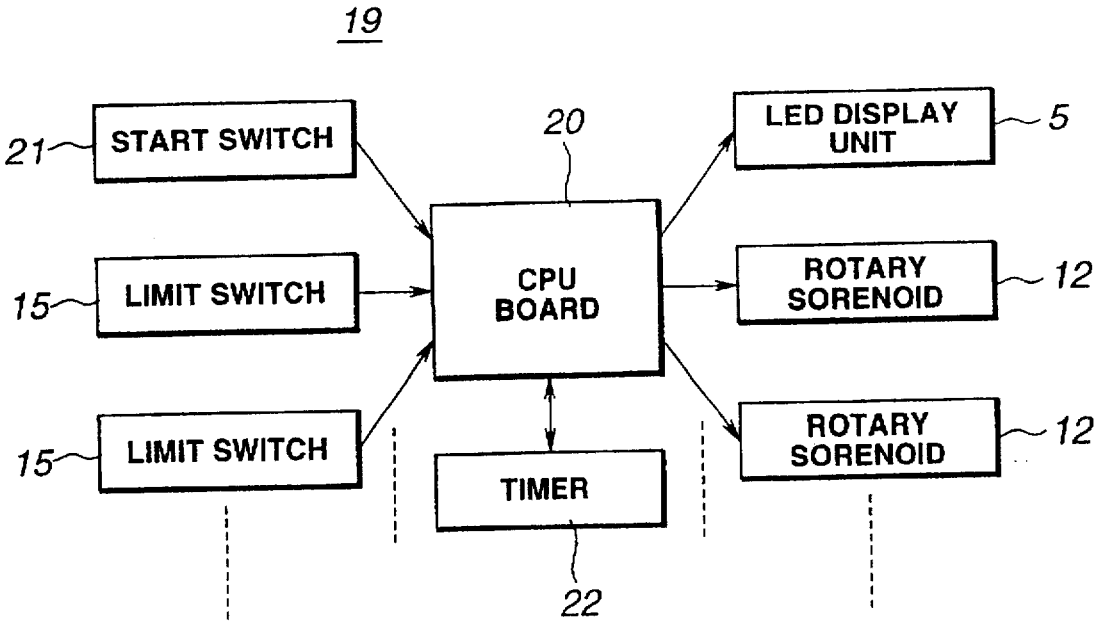
FIG. 5 illustrates a control unit employed in the ball-throw game machine.

FIG. 5 shows a schematic block diagram of the control unit 19 for a single ball-throw game machine 1.

The control unit 19 comprises a CPU board 20 as a main control part to which start switch 21 and the limit switches 15 are connected to supply their target signals. Also connected to the CPU board 20 are the LED display unit 5, to function with a display signal, and the rotary solenoids 12 to be driven with a drive signal. The control unit 19 further comprises a timer 22 to measure the elapsed time of a ball-throw game.

The process executed by the CPU board 20 will be described using FIG. 6.

Figure 6:
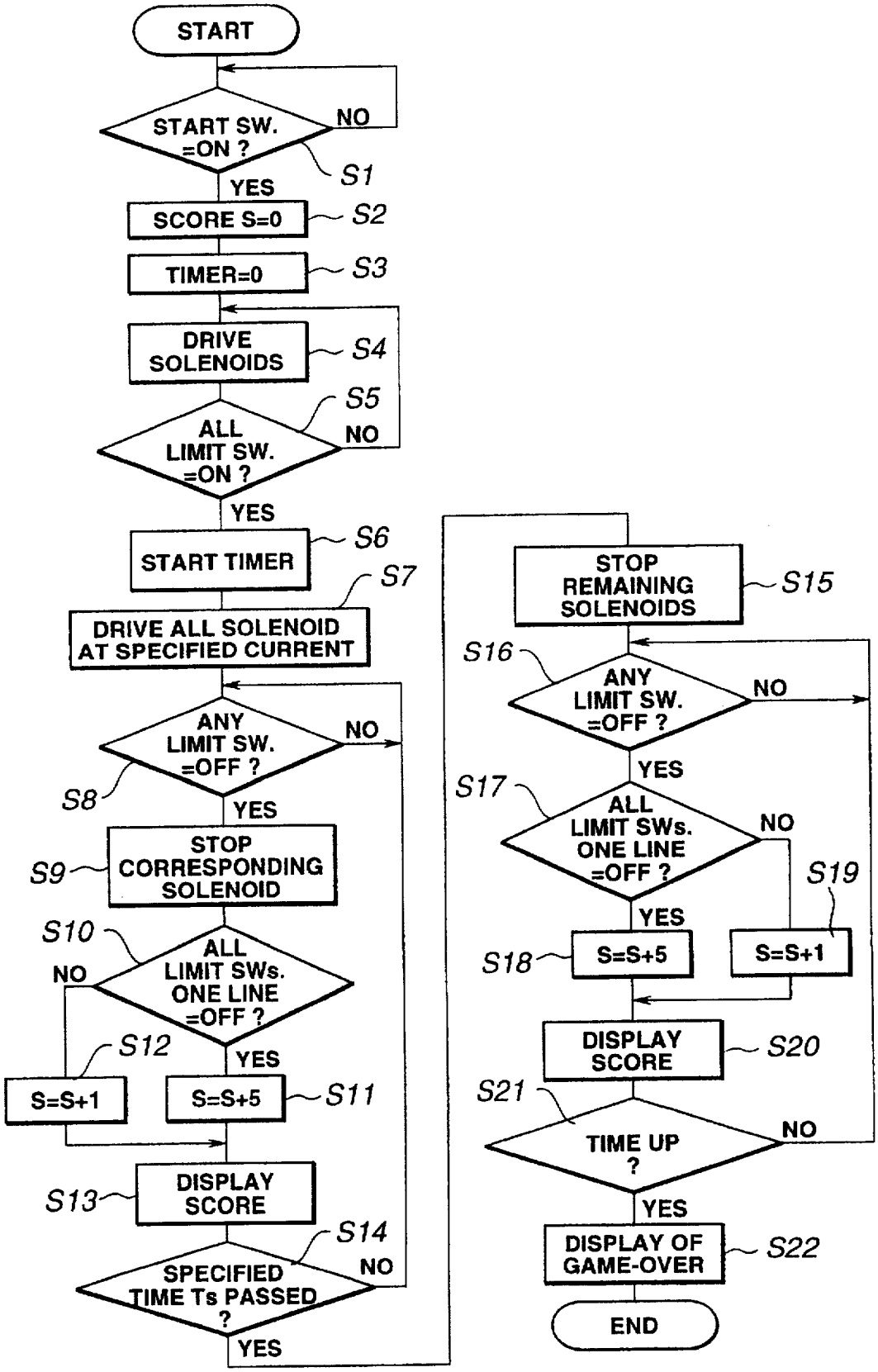
FIG. 6 is a flowchart showing a process carried out by a computer processing unit (CPC) in the first embodiment.

When the start switch 21 is pressed, the CPU board 20 detects this operation (YES at Step S1 in FIG. 6). The CPU board 20 then resets a score S which has been displayed on the LED display unit 5 and instructs the timer 22 to clear its measurement (Steps S2, S3). All of the rotary solenoids 12 are then driven to make vertical all of the targets 4 for closing close all of the rectangular holes 3 (Steps S4 and S5). The verticalization of the targets 4 is confirmed by the "on" state of all the limit switches 15 (Step S5).

After this, the CPU board 20 instructs the timer 22 to start counting the elapsed time (Step S6).

Then the CPU board 20 supplies a respective weak, specified-value currents to the rotary solenoids 12 to produce a respective weak, but specified, electromagnetic forces (Step S7). Hence, all of the rotary solenoids 12 hold all of the targets 4 with a weak, but specified, holding force at the vertical positions. Under such circumstances, a player throws balls at the targets 4.

The CPU board 20 then detects signals from the limit switches 15 and determines whether any limit switch 15 has entered an "off" state (Step S8). If the determination is NO, Step S8 is repeated. A determination of YES (i.e., limit switch is off) represents that the target 4 is sufficiently tilted, in excess of the specified angle, toward the horizontal position and the target 4 will soon fall down onto the cross bar 14 by its own weight. The CPU board 20 then stops providing the corresponding one or more rotary solenoids 12 with the weak, specified currents previously provided (Step S9). The holding force which has been applied to the target 4, is then removed.

The CPU board 20 then determines, by detecting the positions of the limit switches 15 whether all five targets 4 of any one line in the longitudinal, lateral, and oblique directions of the board 2 have fallen down (Step S10). When the determination is YES (i.e., all five targets 4 in one line have fallen), the CPU board 20 calculates a bonus score by calculating S=S+5 (Step S11); if the determination is NO, it calculates a score based on S=S+1 (Step S12). The calculated new score S is then displayed on the LED display unit 5 (Step S13).

Furthermore, the CPU board 20 reads the counted value of the timer 22 and determines whether the elapsed time has reached a predetermined value Ts (Step S14). This value Ts is, for example, a time within a range of 20 to 30 seconds. When the elapsed time has not yet reached the value Ts (i.e., NO at Step S14), the procedure returns to Step S8, and Steps S8 to S14 are repeated. In contrast, if the elapsed time has reached the value Ts (i.e., YES at Step S14), the CPU board 20 stops driving the remaining rotary solenoids 12 (or all the solenoids 12 at that time, thereby all the holding forces to the targets 4 are automatically removed (Step S15).

Then, under such absence of holding forces, Steps S16 to S20 are executed consecutively, to provide the same processing as the above explained Steps S8, S10 to S13. At Step S21, the CPU board 20 reads the counted value of the timer 22 and determines whether the game is over. When the counted value is equal to value Ts, in other words, the elapsed time has reached a predetermined time interval, the CPU board 20 instructs the LED display unit 5 to show that the game has ended (Step S22). While the counted value has not yet reached the predetermined value, the above Steps S16 to S21 are repeated.

Figure 7:
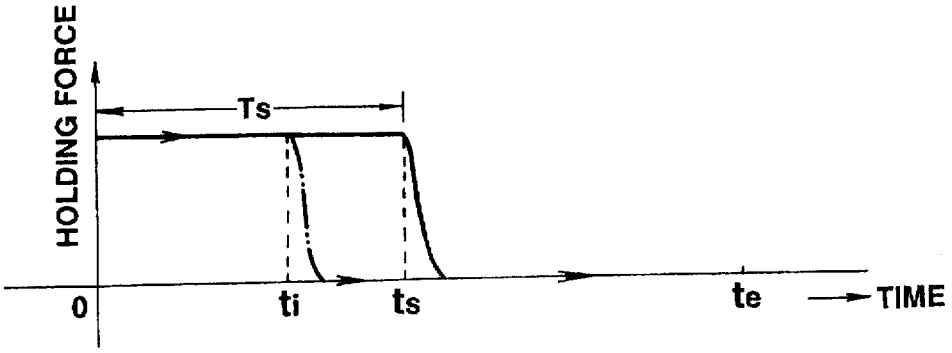
FIG. 7 exemplifies a step-like change in a holding force in the first embodiment.

As understood from the above, during specified time interval Ts from the game start, the targets 4 are put under a condition that they are difficult to knock down due to the individually applied holding forces (refer to FIG. 7). Hence, when the ball B thrown by a player does not have enough motive force due to a slow speed etc., it is difficult to overcome the holding force sustaining the target 4. Even if the target 4 tilts slightly, the holding force may return the target 4 to its initial vertical position.

In contrast, even in the force-adjusting time interval Ts, a ball B sufficiently accelerated and well controlled is able to give much motive force to the target 4. Thus, the target 4 will tilt significantly. This tilting permits the target 4 to reach the limit switch 15, with the result that the existing holding is automatically removed (refer to time ti in FIG. 7). Accordingly, the tilted target 4 continues its falling due to its own weight.

After the predetermined time interval Ts, shown as time Ts in FIG. 7, all the holding forces (or remaining holding forces) to the targets 4 are automatically removed. This removal makes the targets 4 easier to knock down. In consequence, a slower ball or a poorly-controlled ball may knock the target 4 down. A higher probability of knocking down the targets is thus realized.

As explained above, the existence of the force-adjusting time period makes it difficult to knock all the targets down in a very short time even for skilled players. Moreover, throwing techniques between skilled players and non-skilled players do not largely affect the scores, if such a force-adjusting time period Ts is properly-specified. All these factors result in skilled players being prevented from getting bored and score differences between skilled and non-skilled players are reduced in comparison to a conventional ball-throw game machine. Therefore, all of the players can enjoy playing the game.

In the ball-throw game machines 1 of this embodiment, when any one line is completed by knocking down all the target 4 aligned therein, a player is given a bonus score, thus increasing amusement.

In the above embodiment, the ball-throw game machine 1 can be modified such that players compete for the time require to knock down all the targets aligned in any one of a longitudinal, lateral, oblique line of targets. In such a case, it is possible to adjust the above-explained force-adjusting time period, to prevent competitive game times of players from being extremely high and low.

Though the above embodiment operates with a holding force which is decreased in a single step, the present invention can employ a holding force which is weakened over a plurality of steps.

Other embodiments of the present invention are as follows, in which elements or components similar or identical to those in the first embodiment are denoted by the same reference numerals, and the explanation thereof is simplified or omitted.

A second embodiment of the present invention will now be explained with reference to FIGS. 8 to 16.

Figure 8:
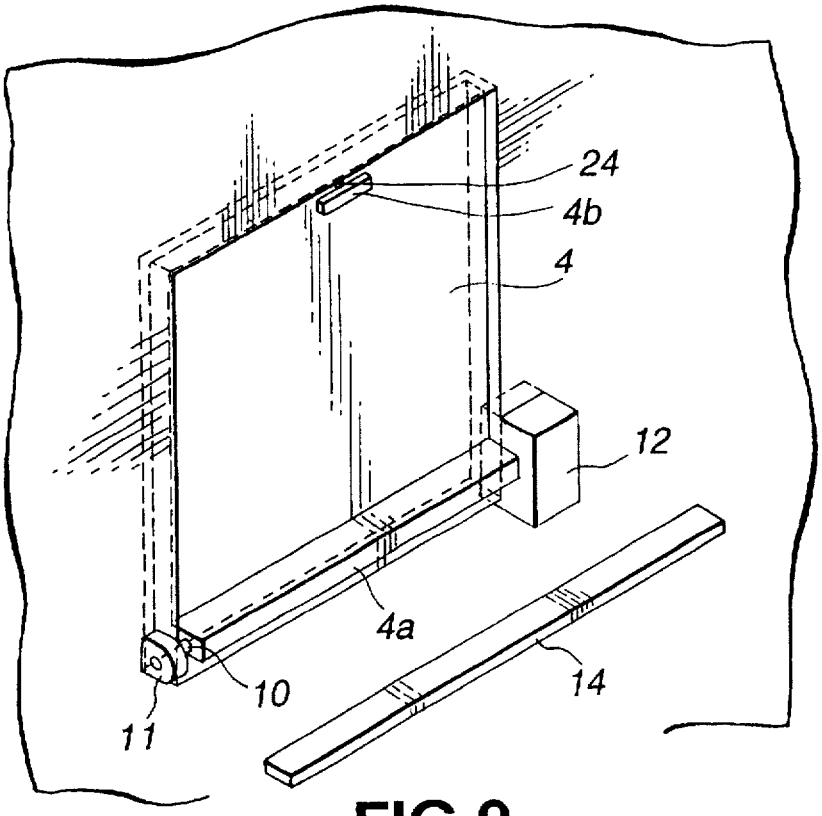
FIG. 8 shows a view of a vertically positioned target in a second embodiment.
Figure 9:
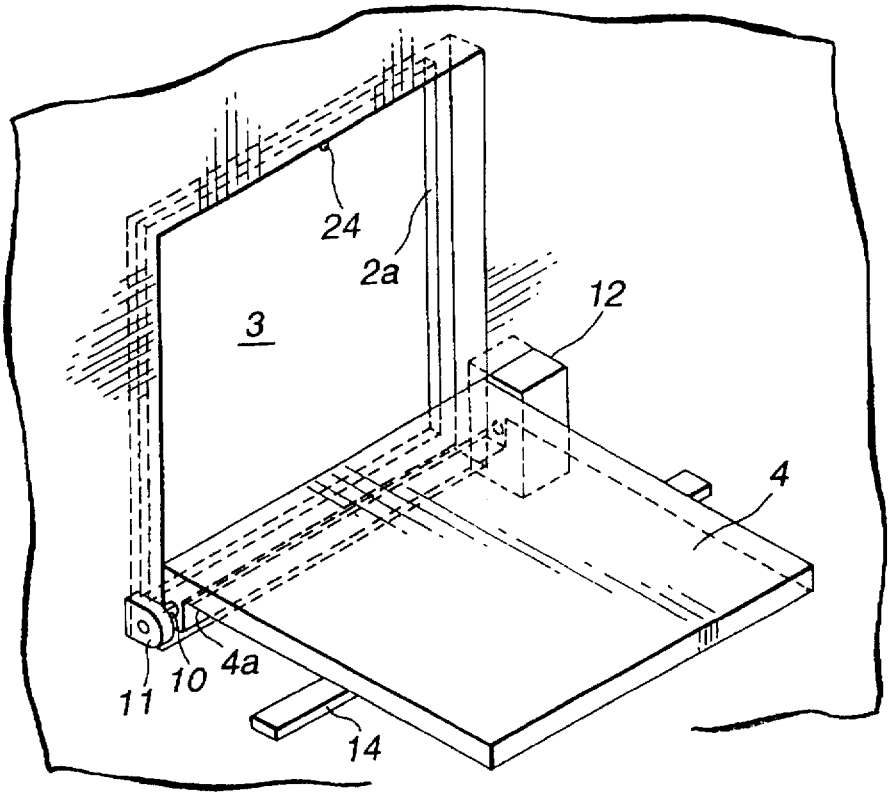
FIG. 9 shows a view of the target horizontally positioned in the second embodiment.
Figure 10:
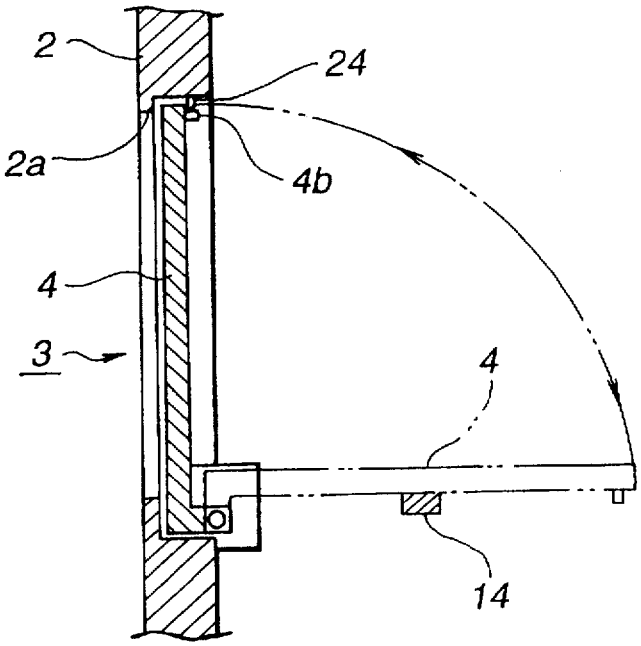
FIG. 10 is a side, cross sectional view of the target of FIGS. 8 and 9.

FIGS. 8 to 10 show one of the rectangular holes 3 and the target 4 which opens and closes the rectangular hole 3. As shown therein, a pinching pin 24 is additionally disposed at the upper side edge of each of rectangular holes 3 of the board 2. The pinching pin 24 is used for pinching the target 4 between the pin 24 and the trimming edge 2a.

Figure 11:
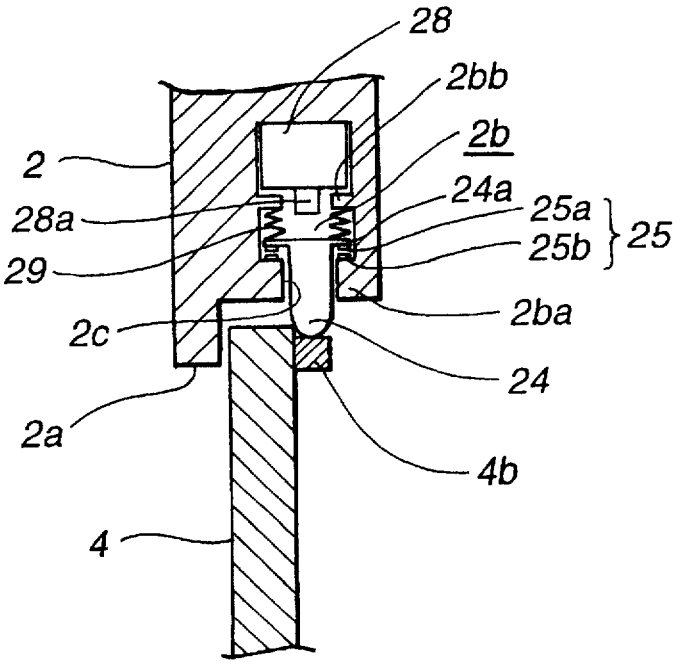
FIG. 11 is a partial cross sectional view showing a solenoid, on-off switch, and pinching pin.
Figure 12:
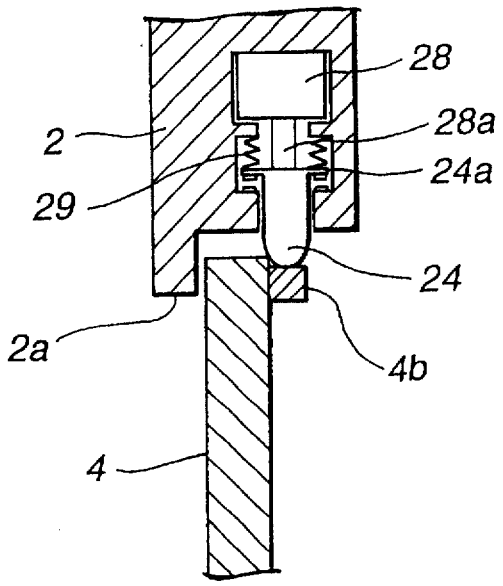
FIG. 12 is a partial cross sectional view showing an "off" state of the on-off switch.
Figure 13:
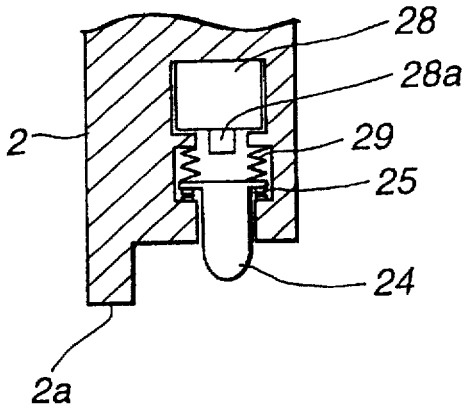
FIG. 13 is a partial cross sectional view showing an "on" state of the on-off switch.
Figure 14:
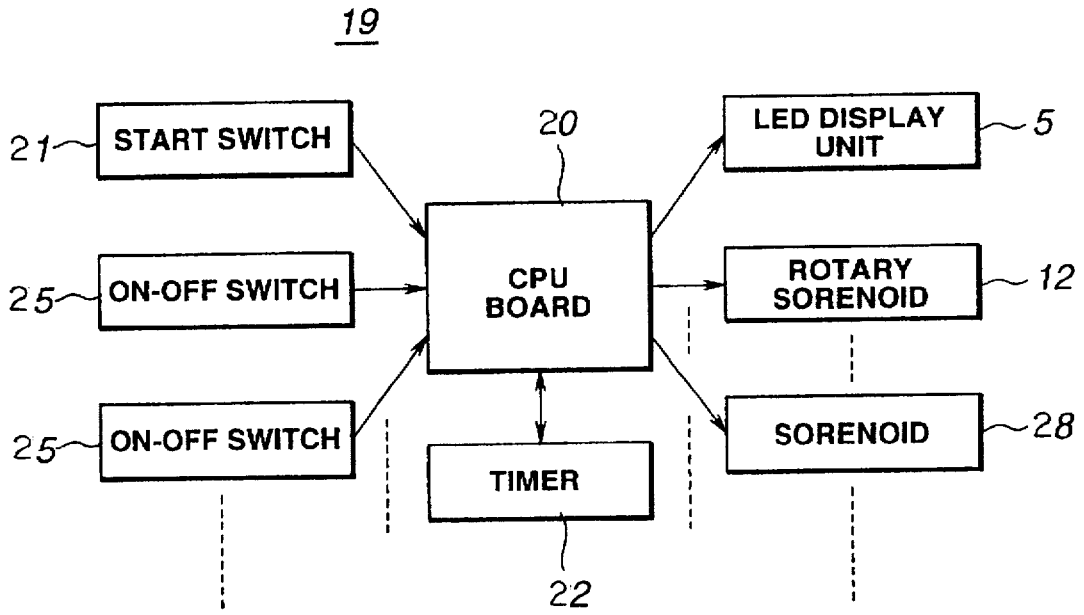
FIG. 14 shows in block form a control unit of the second embodiment.

The pinching pin 24 is illustrated in more detail in enlarged FIGS. 11 to 13. The pinching pin 24 is a pillar member having a smoothly-rounded tip at its lower end and having a flange 24a at its upper end.

At the upper side end of the rectangular hole 3, columnar bore 2b and a small circular-section hole 2c are formed, with a bottom 2ba of the columnar bore 2b connected to the outside. The pinching pin 24 is placed in the small circular-section hole 2c so as to pass downwardly through it, and its flange 24a is fitted into the columnar bore 2b. The flange 24a prevents the pinching pin 14 from falling out. Contacts 25a and 25b are attached to the facing surfaces of the flange 24a and bottom 2ba, respectively, thus forming an on-off switch 25. Contact of both contacts 25a and 25b puts the on-off switch 25 into an "on" state; non-contact of the contacts puts the switch 25 into an "off" state.

In the upper part of the bore 2b, an electric solenoid 28, which is operated, for example, by a chopper-type switching regulator incorporated therein, is held by a ring-like protrusion 2bb formed inside the bore 2b. The electric solenoid 28 has a plunger 28a which extends and withdrawn along its axis in response to electromagnetic force generated therein. The plunger 28a is directed downward through the ring-like protrusion 2bb. A spring 29 is inserted into a space between the ring-like protrusion 2bb and the pinching pin 24.

On the one hand, on the back of the target 4, a rectangular-solid protrusion 4b is securely attached at a position near its free end. The protrusion 4b is aligned with the pinching pin 24. Hence, as shown in FIG. 11, a vertical target 4 permits the pinching pin 24 not only to pinch the upper end of the target 4 in cooperation with the rectangular trimming edge 2a, but also to be pushed up slightly against the spring 29 due to the pressure between the lower tip of the pinching pin 24 and the protrusion 4b of the target 4. Accordingly, the on-off switch 25 is turned "off".

The solenoid 28 shown in FIG. 11 is non-excited and its plunger 28a is withdrawn to be further apart from the pinching pin 24. The pinching pin 24 thus receives only the pushing force of the spring 29. The pushing force is weak and only prevents the target 4 from falling down due to vibration. The hitting of a ball B having an appropriate speed on the target 4 enables the pinching pin 24 to move upward easily, and the target 4 then falls down.

In contrast, when the solenoid 28 is excited by the supplied electric current, its plunger 28a extends outside, as shown in FIG. 12. The plunger 28a thus-extended touches the pinching pin 24 to push it down. This means that a large force is required to push the pinching pin 24 up. Therefore, to push the pinching pin 24 up and knock the target 4 down in this state, a high speed ball is required to hit the target 4. In other words, there is less probability of knocking the target 4 down.

In cases where the target 4 is knocked down, as shown in FIG. 13, the pinching pin 24 loses the hold from the protrusion 4b of the target 4. This causes the pinching pin 24 to lower, thereby making contact between both the contacts 25a and 25b, and turning the on-off switch 25 "on".

As explained above, the on-off switch 25 will be "off" for only a vertical target 4, but otherwise "on". Thus it is able to be used as a sensor for detecting the angular position of the target 4.

Such detection mechanism is arranged at each of the targets 4 and controlled by the control unit 19.

The control unit 19 has a similar construction to that of FIG. 5; however, the limit switches 15 are replaced with the on-off switches 25 and the solenoids 28 are added. The CPU board 20 is also incorporated therein for carrying out processes depicted in FIG. 15.

Figure 15:
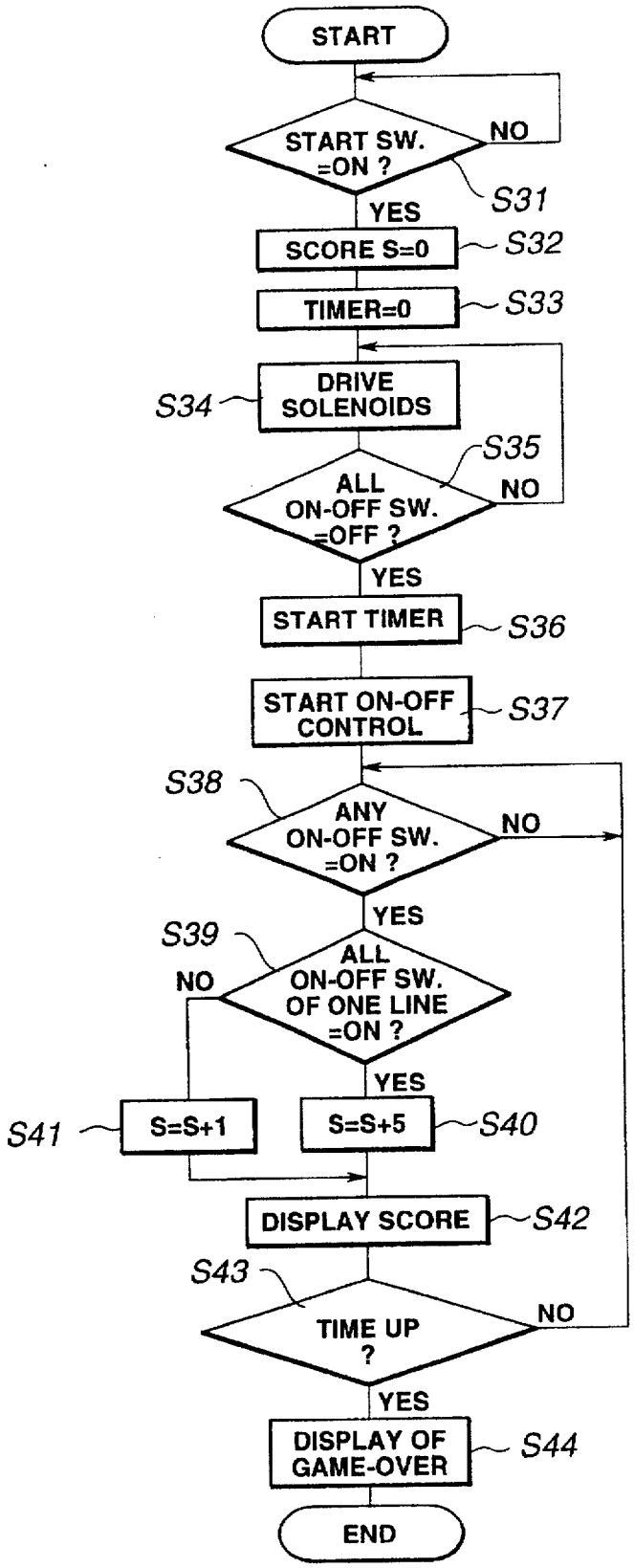
FIG. 15 is a flowchart of a process executed in a CPU in the second embodiment.

FIG. 15 depicts a main chart, in which Steps S31 to S36 are largely similar to Steps S1 to S6 in FIG. 6. Only Step S35 is different in that the "off" signal from the on-off switch 25 is used for detecting all the vertical targets 4.

After Step S36, the CPU board 20 performs Step S37, at which a sub-program (not illustrated) of on-off control is instructed for supplying electric current to the solenoids 28 disposed at the targets 4. This sub-program is carried out by the same CPU board 20 in parallel with the main program in FIG. 15 on a time-shared basis, for instance.

Figure 16:
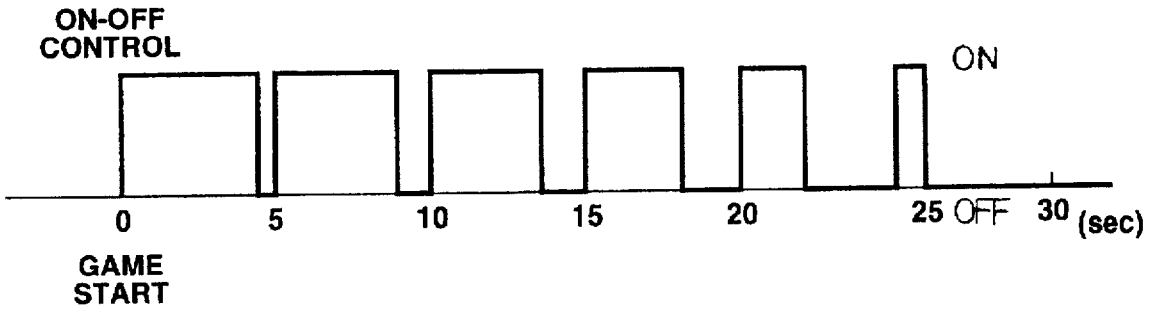
FIG. 16 is a timing chart showing an on-off control for a current supply to the solenoid.

In detail, in the sub-program, a table look-up is carried out to obtain data. The CPU board 20 has a table in its memory, and the table has pre-stored reference data corresponding to on-off control for electrical current as shown in FIG. 16. The reference data is made up of an elapsed time vs. on/off instruction. FIG. 16 exemplifies a changing manner of a duty ratio of currents, in which the duty ratio is gradually decreased. For instance, in the first predetermined period of 5 sec, an interval of 4.5 sec is on (current supplied) and the remaining interval of 0.5 sec is off (current not-supplied), in the next period, 4 sec is on and 1 sec is off, in the next period, 3.5 sec is on and 1.5 sec is off, and the same decreasing method is applied to the remaining periods. Finally, a non-current state is obtained at the elapsed time which is approximately 30 sec from the game start.

In parallel with such on-off control to each of the solenoids 28, the CPU board 20 carries out Steps S38 to S44 similar to Steps S8, S10 to S13, S21 and S22 previously-described in FIG. 6. At Steps S38 and S39, a determination that any target 4 has been knocked down is made based on "on" signals from the on-off switches 25. These Steps S38 to S44 enable the counting and displaying of the score (including a bonus score) and the display of the end of the game.

When current is supplied to the solenoid 28, its plunger 28a extends to push the pinching pin 24, thus making it difficult to knock down the target 4. In particular, in the beginning of the game, a percentage of the supplied current is greater, thus such difficulty in knocking the target 4 down is noticeable. Since the percentage is decreased as the elapsed time increases, the electromagnetic force generated in each solenoid 28 is almost continuously decreased, thus it becomes gradually easier to knock down the target 4.

In the period in which such a gradually-decreased holding force is supplied, a well-accelerated and/or well-controlled ball B can overcome the pushing force generated by the solenoid 28, so that the pinching pin 24 is pushed up to allow the target 4 to be knocked down. In contrast, when a ball B lacks speed and is not well controlled to meet the most sensitive spot of the target, it is difficult to knock the target 4 down.

After the specified time (appr. 30 sec in this embodiment) has passed from the game start, the current supply to the solenoids 28 is completely stopped and no holding force is applied to the targets 4. Accordingly, even if a ball B does not have much speed or is not well controlled, the target 4 can be readily knocked down. The probability of knocking down the target 4 is thus remarkably increased.

As clearly understood from the above, the almost continuous decrease in the holding force for the targets 4 provides the equivalent advantages of the first embodiment.

In the above second embodiment, the solenoids 28 may be directly controlled by a control current that continuously decreases from a specified value to zero, without adopting the above-explained on-off control in the "chopper" method.

Furthermore, the above second embodiment may employ a removing device which necessarily removes the holding force which works, when the on-off switch 25 detects a falling target, in the same manner as in the first embodiment.

A third embodiment of the present invention will be explained with reference to FIG. 17.

Each of the ball-throw game machines 1 employs almost the same hardware construction as that of the first embodiment. The only difference which exists is that the CPU board 20 executes the procedures shown in FIG. 17 instead of those in FIG. 6.

Figure 17:
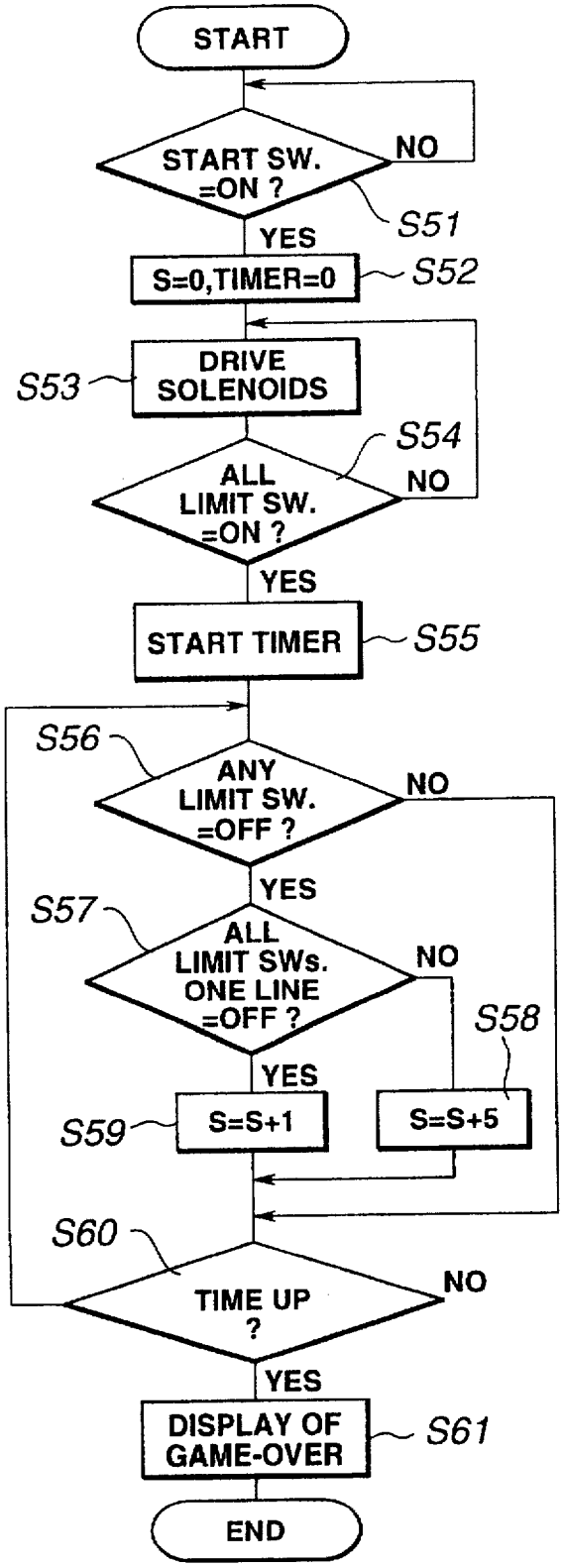
FIG. 17 is a flowchart of a process carried out by the CPU in a third embodiment.

In FIG. 17, Steps S51 to S61 are the same as Steps S1 to S6 and S16 to S22 shown in FIG. 6 (Steps S58 an S59 include the display of the score S, respectively.), and the process of adjusting the holding force to the target 4 is omitted to obtain a simplified process. Thus, the limit switch 15 employed in the first embodiment is also omitted.

Although the process is simplified, the ball-throw game machine 1 still requires strategy to get a higher score. First, it is better for a player P to throw a ball at the central target 4 of the board 2, because the central target 4 is strategically the best target which can be used to efficiently knock down all the targets 4 aligned in any one of longitudinal, lateral or oblique lines. Knocking down all the targets 4 in such a line leads to the bonus score, thus obtaining a higher score which is the object of the game.

As a consequence, the requirements of such a strategy helps a player to avoid getting bored and to maintain interest in the game for a long time.

A fourth embodiment of the present invention will be explained using FIGS. 18 and 19.

Figure 18:
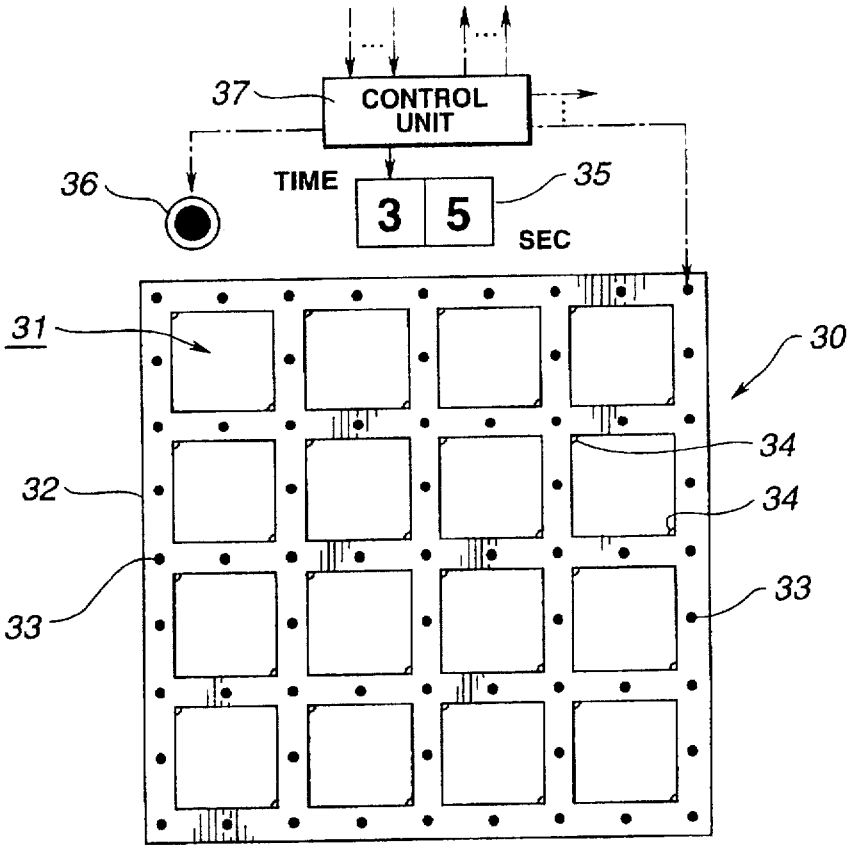
FIG. 18 shows a board-display condition in the fourth embodiment.
Figure 19:
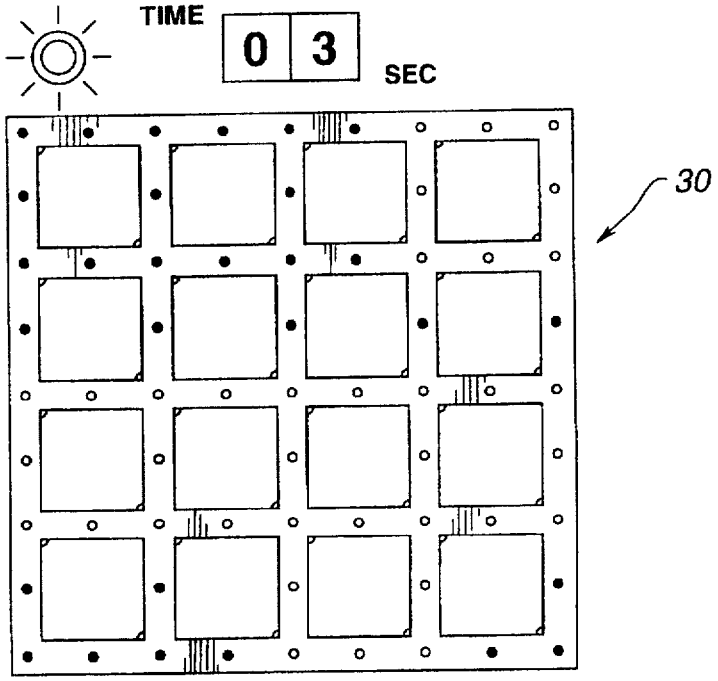
FIG. 19 shows another board-display condition in the fourth embodiment.

FIGS. 18 and 19 show the front of an identical board 30 of another ball-throw game machine in which a player throws balls. The board 30 has 16 rectangular holes 31 arranged regularly therein with a grid-like configuration of 4-rows and 4-columns. However, the board 30 does not have plate-like targets; namely the plurality of rectangular holes 31 themselves comprise targets. This is different from the board 2. Passing a ball P through the rectangular hole 3 comprises a hit.

A plurality of lamps 33 are disposed on each frame portion 32 which, in turn, forms each rectangular hole 31. A pair of photosensors 34 are each placed at diagonal corners of each rectangular hole 31, so that the photosensors 34 detect a ball passing therethrough. Furthermore, the board 30 has an LED display unit 35 disposed at its central upper part, and it also has a single LED display lamp 35 disposed at the upper left-side.

The ball-throw game machine of this embodiment has a control unit 37 for processing signals from the photosensors 34 and for controlling the small lamps 33, display lamp 36, and LED display unit 35. First, the control unit 37 counts down a limited time for this ball-throw game and displays the limited time on the LED display unit 35. Second, when detecting a ball passing through one of the holes 31 using the photosensors 34, the control unit 37 lights up the small lamps 33 correspondingly positioned around the hit rectangular hole 31 to represent the hit. Third, the control unit 37 instructs the display lamp 36 to light up, in case all the rectangular holes 31 aligned in any one of longitudinal, lateral or oblique lines of targets on the board 30 are hit.

The other components are the same as those in the first or third embodiment.

FIG. 18 exemplifies a board-display condition at the start of this ball-throw game; all the small lamps 33 and the single display lamp 36 are off and the LED display unit 35 shows that the limited time of the game is 35 sec.

A player begins to throw balls at the display board 30. During the play, the LED display unit 35 shows the decrease in the limited game time, whereas the small lamps 33 around a hit rectangular hole 31 are lit up.

FIG. 19 exemplifies another board-display condition in which all the rectangular holes 31 in a certain lateral line of targets have been hit at a time when the limited game time of 3 sec is only left, and the display lamp 36 is lit up.

As explained above, the ball-throw game machine is used for hitting all the holes of any one line within a specified limited game time, not for score competition. Thus, failure in strategy of throwing balls sometimes leads to unsatisfactory results—that is, all the rectangular holes 31 in any one line may not be hit within a specified game time. It is important that a player always use a more effective strategy for throwing balls and change it quickly according to results in the middle of the game. Accordingly, compared with the conventional game in which a player simply throws balls at any target, the ball-throw game of this embodiment is more strategic and attractive.

Instead of the foregoing plural targets each having a rectangular shape, it is possible to employ a single target system having a rectangular shape. The shape of the target may also be formed into round, triangular, or other shapes. Further, the rectangular target in the above embodiment, of course, includes a square target.

Although the present invention has been described with reference to particular embodiments, the descriptions are only examples of the invention's application and should not be taken as limitations.

What is claimed is:

1. A machine for playing a ball throw game, in which a player throws a ball at a target arranged in a board member for a predetermined length of time, the game machine comprising:

mean for attaching the target to the board member, the target swinging from a given vertical position to a given horizontal position;

a unit for providing a holding force to the target positioned at the vertical position; and a control unit for decreasing the holding force as a length of time the player is playing the ball-throw game approaches the predetermined length of time.

2. The game machine according to claim 1, wherein said target comprises a plurality of targets arranged in a lattice configuration in the board member, each of the plurality of targets being a plate member.

3. The game machine according to claim 2, wherein said plate member is rectangular in shape.

4. The game machine according to claim 1, wherein said control unit comprises means for measuring the length of time the player is playing the ball-throw game, and means for decreasing the holding force stepwise in accordance with the measured length of time the player is playing.

5. The game machine according to claim 4, further comprising:

a sensor for detecting a tilt angle of the target;

means for judging whether the detected tilt angle reaches a specified angle; and means for compulsorily removing the holding force when the judging means judge that the detected tilt angle has reached the specified angle.

6. The game machine according to claim 4, wherein said holding force decreasing means comprises a time judging means for judging whether the length of time the player is playing reaches the predetermined length of time; and means for removing the holding force stepwise when said time judging means judges that the length of time the player is playing ha reached the predetermined length of time.

7. The game machine according to claim 6, further comprising:

a sensor for detecting a tilt angle of the target;

a tilt judging means for judging whether the detected tilt angle reaches a specified angle; and mean for compulsorily removing the holding force when the tilt judging means judges that the detected tilt angle has reached the specified angle.

8. The game machine according to claim 7, wherein said tilt angle sensor is a limit switch arranged on the board member so to contact the target.

9. The game machine according to claim 1, wherein said control unit comprises means for measuring the length of time the player is playing the ball-throw game; and means for decreasing the holding force in accordance with the measured length of time the player is playing.

10. A game machine for playing a ball throw game, in which a player throws a ball at a plurality of targets arranged in a lattice configuration in a board member, the game machine comprising:

means for attaching the plurality of targets to the board member, each of the targets swinging from a vertical position to a horizontal position and each of the plurality of targets being a plate member;

means for providing a holding force to each of the plurality of targets positioned at the vertical position;

means for measuring a length of time the player is playing the ball-throw game;

means for judging whether the measured length of time the player is playing reaches a specified value;

means for removing the holding force stepwise when the judging means judges that the length of time the player is playing has reached the specified value;

a plurality of limit switches for detecting a specific angular status at which each of the plurality of plate members tilting downward meets a specified angle; and means for compulsorily removing the holding force when any of the plurality of limit switches judges the specific angular status.

11. A method of adjusting behavior of a target in a ball-throw game machine, in which a player throws a ball at the target held so as to swing from a vertical position to a horizontal position, the method comprising the steps of:

providing a holding force to the target positioned at the vertical position; and decreasing the holding force in accordance with a length of time the player is playing the ball-throw game.

12. The method according to claim 11, wherein said holding force is decreased stepwise in accordance with the length of time the player is playing.

13. The method according to claim 11, wherein said holding force is decreased until the length of time the player is playing equals a predetermined length of time.

* * * * *